US007847751B2

(12) United States Patent
Schano

(10) Patent No.: US 7,847,751 B2
(45) Date of Patent: Dec. 7, 2010

(54) PLANAR BROADBAND ANTENNA

(75) Inventor: Thomas Schano, Giesen (DE)

(73) Assignee: Robert Bosch GmbH, Stuttgart (DE)

( * ) Notice: Subject to any disclaimer, the term of this patent is extended or adjusted under 35 U.S.C. 154(b) by 588 days.

(21) Appl. No.: 11/667,428

(22) PCT Filed: Sep. 9, 2005

(86) PCT No.: PCT/EP2005/054492

§ 371 (c)(1),
(2), (4) Date: Feb. 28, 2008

(87) PCT Pub. No.: WO2006/051010

PCT Pub. Date: May 18, 2006

(65) Prior Publication Data

US 2008/0297430 A1 Dec. 4, 2008

(30) Foreign Application Priority Data

Nov. 9, 2004 (DE) ..... 10 2004 054 015

(51) Int. Cl.
*H01Q 1/50* (2006.01)

(52) U.S. Cl. ..... 343/860; 343/841

(58) Field of Classification Search ..... 343/700 MS, 343/841, 860

See application file for complete search history.

(56) References Cited

U.S. PATENT DOCUMENTS

| | | | | |
|---|---|---|---|---|
| 6,124,829 | A | 9/2000 | Iwasaki | |
| 6,590,541 | B1 | 7/2003 | Schultze | |
| 6,819,287 | B2 * | 11/2004 | Sullivan et al. | 343/700 MS |
| 7,436,360 | B2 * | 10/2008 | Chen et al. | 343/700 MS |
| 2003/0076269 | A1 | 4/2003 | Kuramoto | |

FOREIGN PATENT DOCUMENTS

| | | |
|---|---|---|
| EP | 0 444 679 | 9/1991 |
| JP | 2000 091834 | 3/2000 |
| JP | 2003 133841 | 5/2003 |
| WO | WO 2004/073112 | 8/2004 |

* cited by examiner

*Primary Examiner*—Tan Ho
(74) *Attorney, Agent, or Firm*—Kenyon & Kenyon LLP

(57) ABSTRACT

A planar broadband antenna includes a flat elliptical antenna device. The elliptical antenna device includes a central antenna element, a first angular antenna element and a second angular antenna element. The central antenna element is disposed parallel to a support. The angular antenna elements are formed by two opposite segments of the elliptical antenna device and point toward the support. The first angular antenna element is provided with a base point through which a signal is capable of being fed in. An impedance device connects the second angular antenna element to a ground point located near the base point.

10 Claims, 2 Drawing Sheets

PLANAR BROADBAND ANTENNA

FIELD OF THE INVENTION

The present invention relates to a planar broadband antenna. Although the present invention is described with reference to an antenna mounted on a vehicle, the invention is not limited thereto.

BACKGROUND INFORMATION

Wireless communication devices are increasingly used in vehicles. In order to allow and/or improve communication of these devices with base stations located outside the vehicle, antennas are mounted on the vehicle. In this connection, efforts are directed to provide only one antenna for all frequency bands used, if possible. The nowadays-used bands of the radio frequency spectrum range from 800 MHz to 5 GHz. Until now, planar inverted-F antennas (PIFA) have been used, which provide a plurality of discrete resonances in their antenna structure. By skillfully designing slots in a flat planar element of the PIFA, it is possible to adjust the radiation pattern of the antenna to the frequency bands needed. However, this requires the PIFA to be adapted as a function of its environment in order to obtain the appropriate radiation pattern because the discrete frequencies shift as a function of the environment. As a result, the antenna design must be adapted for each new vehicle or for a different antenna position on the vehicle.

Another antenna is a circular disk monopole, which includes a circular antenna element disposed in a vertical position with respect to a support. The circular antenna element is connected to the core of a coaxial cable. The radiation pattern of the circular disk monopole has a minimum frequency. Above this minimum frequency, a nearly continuous radiation pattern is obtained for the monopole in the frequency space. Therefore, there is no need for the circular disk monopole to be adapted to the environment. The disadvantage of the circular disk monopole is its vertical design and the space requirements associated therewith. The circular antenna element typically has a diameter of about 10 cm. Also, measures have to be taken to protect the projecting round antenna element against mechanical influences.

An object of the present invention is to provide an improved broadband antenna having a small height.

SUMMARY OF THE INVENTION

This objective is achieved by a planar broadband antenna according to the present invention. A basic idea of the present invention is that a planar broadband antenna includes a flat elliptical antenna device. The elliptical antenna device includes a central antenna element, and first and second angular antenna elements. The central antenna element is disposed parallel to a support. The angular antenna elements are formed by two opposite segments of the elliptical antenna device and point toward the support. The first angular antenna element is provided with a base point through which a signal is capable of being fed in. An impedance device connects the second angular antenna element to a ground point located near the base point.

The present invention has the advantage over the known approaches that the planar broadband antenna has a small height. In addition, the flat elliptical antenna device provides a nearly continuous radiation pattern in a wide frequency band. The radiation pattern is substantially similar to that of a circular disk monopole antenna.

In a preferred refinement, the impedance matching device is flat and elliptical in shape. The substantially symmetrical design of the impedance matching device and the elliptical antenna device provides excellent impedance matching. In another refinement, the impedance matching device accordingly has angular elements.

In a further preferred refinement, the impedance device has discrete components.

In yet another preferred refinement, the antenna device and/or the impedance device is/are circular in shape.

According to another refinement, the support is conductive and connected to ground.

In a further refinement, a shielding device is mounted between the impedance matching device and the antenna device. Advantageously, the shielding device makes it possible to suppress unwanted signal transmission from the impedance matching device through the air to the antenna device.

In another refinement, the impedance matching devices are disposed on opposite sides of the support.

In yet another refinement, the elliptical shapes are approximated by polygonal shapes.

DETAILED DESCRIPTION

Figure 1:
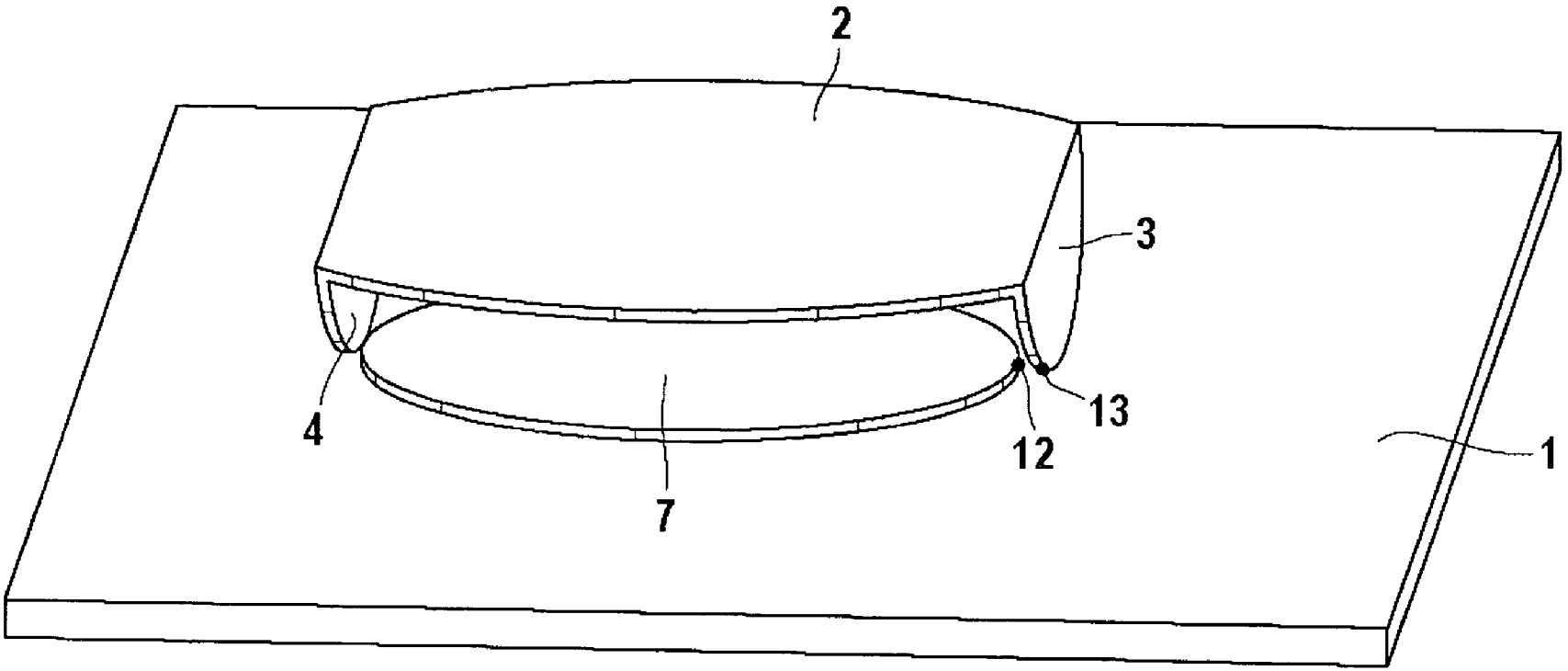
FIG. 1 shows a specific embodiment of the present invention in a three-dimensional view.
Figure 2A:
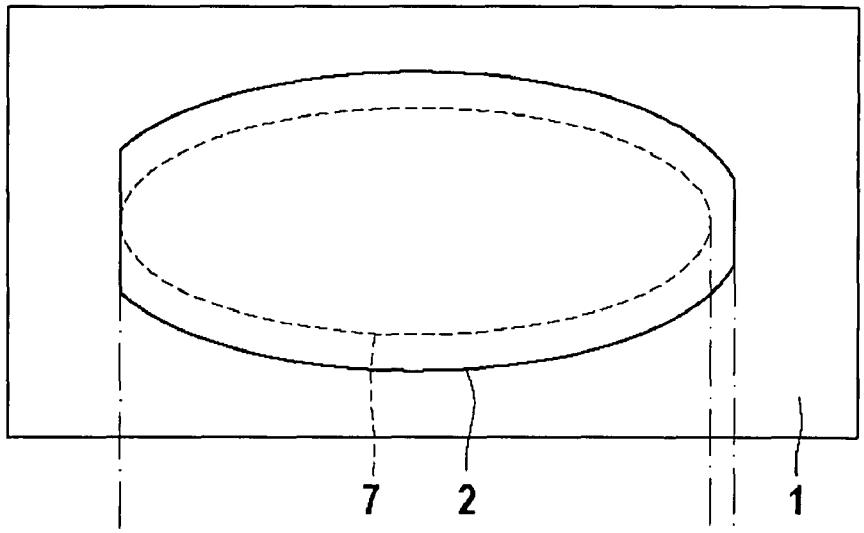
FIGS. 2*a* and 2*b* show the specific embodiment of the present invention in a top view and a side view.
Figure 2B:
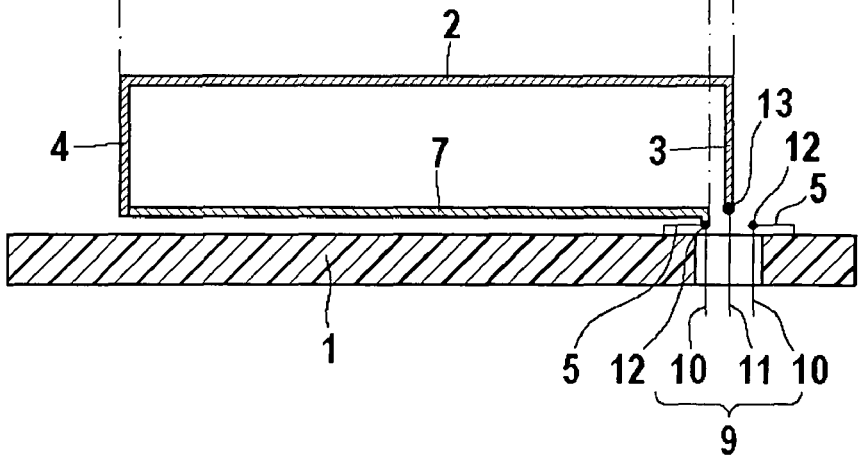
Figure 3:
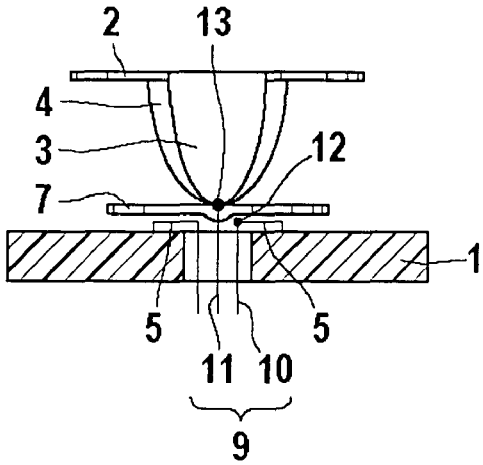
FIG. 3 shows the specific embodiment of the present invention in a side view as viewed in a second direction.

FIGS. 1, 2*a*, 2*b* and 3 illustrate a specific embodiment of the present invention. A flat elliptical antenna device is disposed above a conductive support 1. The antenna device includes a central antenna element 2, a first angular antenna element 3 and a second angular antenna element 4. Central antenna element 2 is substantially elliptical in shape, except for two opposite segments missing in the ellipse. The angular antenna elements have exactly the shape of these missing segments. The antenna device can be correspondingly shaped, starting from an ellipse, by folding of the two segments.

The tip of first angular antenna element 3 is provided with a base point 13. Base point 13 is connected to core 11 of a coaxial cable 9. Coaxial cable 9 can connect the broadband antenna to transmitter and/or receiver devices. The coaxial cable is an example of conductors which are suitable for transmitting high-frequency signals.

The tip of second angular antenna element 4 is connected to an impedance matching device 7. Matching device 7 is also elliptical in shape. Impedance matching device 7 connects the tip of second angular antenna element 4 to a ground point 12. This ground point 12 is located near base point 13. Ground point 12 can be connected to shield 10 of coaxial cable 9.

In the specific embodiment shown, impedance matching device 7 is located on the same side of support 1 as central antenna element 2. Another embodiment provides for impedance device 7 to be disposed on the other side of support 1. To this end, support 1 must be provided with a hole through which second antenna element 4 can be connected to impedance device 7.

The advantage of the planar broadband antenna is the relatively small height, which, in one embodiment, is about 2 cm. The elliptical design of the antenna device and of impedance matching device 7 provides a radiation pattern which, like a circular disk monopole, advantageously has a wide emission band. This allows this antenna to be universally used for a large frequency spectrum without having to be adapted to the environment of the installation location.

The broadband antenna has no preferred radiation direction in the plane of the support, but emits omnidirectionally. This is necessary to use the antenna in a moving vehicle, because the alignment of the antenna cannot be achieved without great difficulty while driving.

Impedance matching device 7 can be shielded by one or more additional ground surfaces. In this manner, interactions between central antenna element 2 and impedance matching device 7, which are caused by emissions from impedance device 7, can be suppressed.

This ensures that interaction is only through conductive contacts, and that interference effects are avoided.

Although the present invention has been described above with reference to a preferred exemplary embodiment, it is not limited thereto but can be modified in many ways.

The shape of the antenna elements can be approximated by polygonal shapes.

Moreover, the impedance matching device can include discrete components.

What is claimed is:

1. A planar broadband antenna comprising:

a support;

a flat elliptical antenna device mounted on the support and including a central antenna element, a first angular antenna element and a second angular antenna element, the central antenna element being situated parallel to the support, the angular antenna elements being formed by two opposite segments of the elliptical antenna device, the angular antenna elements pointing toward the support, a signal being capable of being fed in at a base point on the first angular antenna element; and an impedance matching device connecting the second angular antenna element to a ground point situated near the base point.

2. The planar broadband antenna according to claim 1, wherein the impedance matching device is flat and elliptical in shape.

3. The planar broadband antenna according to claim 2, wherein the impedance matching device has angular elements.

4. The planar broadband antenna according to claim 2, wherein the impedance matching device includes discrete components.

5. The planar broadband antenna according to claim 1, wherein at least one of the antenna device and the impedance matching device is circular in shape.

6. The planar broadband antenna according to claim 1, wherein the support is conductive and connected to ground.

7. The planar broadband antenna according to claim 1, further comprising a shielding device mounted between the impedance matching device and the antenna device.

8. The planar broadband antenna according to claim 1, wherein the impedance matching device and the antenna device are situated on opposite sides of the support.

9. The planar broadband antenna according to claim 1, wherein elliptical shapes are approximated by polygonal shapes.

10. The planar broadband antenna according to claim 1, wherein the impedance matching device includes discrete components.

* * * * *